US008813996B2

(12) United States Patent
Steih et al.

(10) Patent No.: US 8,813,996 B2
(45) Date of Patent: Aug. 26, 2014

(54) HEAT SET CONTAINER

(75) Inventors: Richard J. Steih, Jackson, MI (US); Brian L. Pieszchala, Ann Arbor, MI (US); Chris Labombarbe, Ypsilanti, MI (US); Chad Keilen, Ann Arbor, MI (US)

(73) Assignee: Amcor Limited, Hawthorn (AU)

( * ) Notice: Subject to any disclaimer, the term of this patent is extended or adjusted under 35 U.S.C. 154(b) by 530 days.

(21) Appl. No.: 12/721,003

(22) Filed: Mar. 10, 2010

(65) Prior Publication Data

US 2011/0220668 A1 Sep. 15, 2011

(51) Int. Cl.
*B65D 90/02* (2006.01)

(52) U.S. Cl.
USPC ..... 220/675; 220/669; 215/381; 215/382

(58) Field of Classification Search
USPC ..... 220/669, 673, 675, DIG. 12, 670; 215/381, 382, 379, 380, 383, 384
See application file for complete search history.

(56) References Cited

U.S. PATENT DOCUMENTS 4,749,092 A * 6/1988 Sugiura et al. ..... 215/381
5,067,622 A * 11/1991 Garver et al. ..... 215/381
6,044,996 A 4/2000 Carew et al.
7,021,479 B2 * 4/2006 Pedmo et al. ..... 215/381
7,137,520 B1 11/2006 Melrose
2002/0000421 A1 * 1/2002 Ota et al. ..... 215/381
2005/0269284 A1 12/2005 Pedmo et al.
2006/0289378 A1 * 12/2006 Zhang ..... 215/381

FOREIGN PATENT DOCUMENTS

JP 2007-076717 3/2007

OTHER PUBLICATIONS

International Search Report and Written Opinion dated Sep. 21, 2011 from corresponding International Patent Application No. PCT/US2011/021615 (seven pages).

* cited by examiner

*Primary Examiner* — Jeffrey Allen
(74) *Attorney, Agent, or Firm* — Harness, Dickey & Pierce, P.L.C.

(57) ABSTRACT

A heat set container having a shoulder portion and a sidewall portion extending from the shoulder portion to a base. The base closes off an end of the container. The shoulder portion, the sidewall portion, and the base cooperate to define a receptacle chamber within the container into which product can be filled. The sidewall portion defines a major container diameter of the container. The sidewall portion includes an upper vacuum absorbing region joined to a lower vacuum absorbing region at a reduced waist section. The reduced waist section forms a minor container diameter which is less than the major container diameter. In some embodiments, such configuration forms an hourglass, heat-set container, wherein the upper vacuum absorbing region and the lower vacuum absorbing region are collectively shaped to provide flexible absorption of an internal vacuum within the receptacle chamber.

13 Claims, 8 Drawing Sheets

HEAT SET CONTAINER

FIELD

This disclosure generally relates to containers for retaining a commodity, such as a solid or liquid commodity. More specifically, this disclosure relates to a heat-set, polyethylene terephthalate (PET) container having a pair of vacuum absorbing regions inwardly tapered toward each other to form a narrow, circumferential waist section relative to the major diameter(s) of the container.

BACKGROUND

This section provides background information related to the present disclosure which is not necessarily prior art.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

SUMMARY

This section provides a general summary of the disclosure, and is not a comprehensive disclosure of its full scope or all of its features.

According to the principles of the present teachings, a heat set container having a shoulder portion and a sidewall portion extending from the shoulder portion to a base is provided. The base closes off an end of the container. The shoulder portion, the sidewall portion, and the base cooperate to define a receptacle chamber within the container into which product can be filled. The sidewall portion defines a major container diameter of the container. The sidewall portion includes an upper vacuum absorbing region joined to a lower vacuum absorbing region at a reduced waist section. The reduced waist section forms a minor container diameter which is less than the major container diameter. In some embodiments, such configuration forms an hourglass, heat-set container, wherein the upper vacuum absorbing region and the lower vacuum absorbing region are collectively shaped to provide flexible absorption of an internal vacuum within the receptacle chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
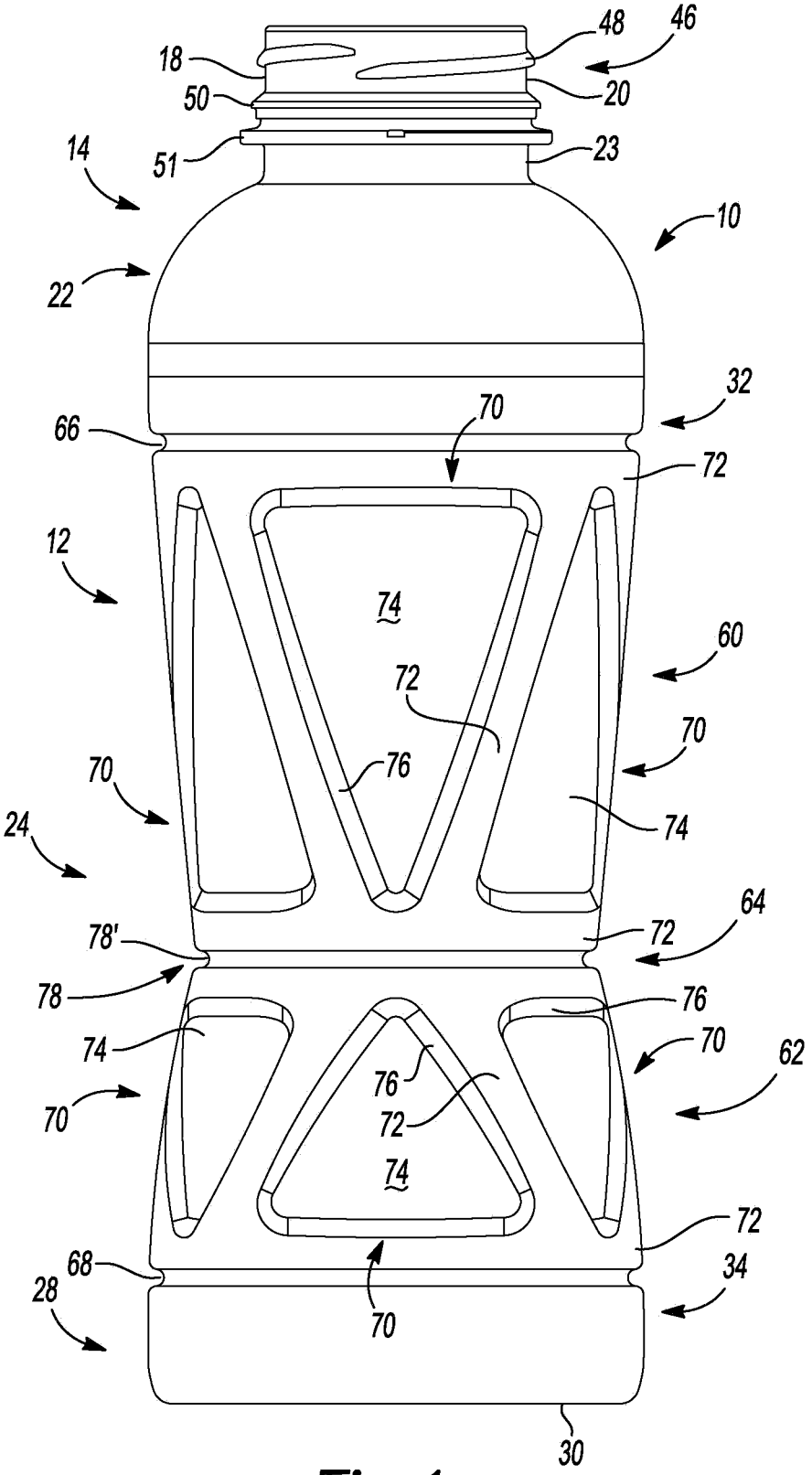
FIG. 1 is a front view of a plastic container constructed in accordance with some embodiments of the present disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container having an hourglass shape that effectively absorbs an internal vacuum while maintaining its basic shape. The hourglass shape can be described as having two or more inverted conical or barrel sections that together form a reduced waist section. The container of the present teachings, unlike conventional heat set containers, is non-cylindrical and need not include any vertical columns. The reduced waist section can comprise a horizontal reinforcing belt with stiffening features at the minor diameter. This structure results in separate upper and lower vacuum absorbing regions for improved vacuum and container performance.

As will be discussed in greater detail herein, the shape of the heat set container of the present teachings can be formed according to one of at least two variations. Firstly, the present container can be formed having an even number of alternating (such as reversing) triangular or trapezoidal vacuum panels around the circumference. Secondly, the present container can be formed having a number of trapezoidal vacuum panels arranged around the container circumference such that the smaller end of the trapezoidal panel is next to or generally adjacent the minor diameter of the container and the larger end is next to or generally adjacent the major diameter(s).

It should be appreciated that the size and the number of vacuum panels are dependent on the size of the container and the required vacuum absorption. Therefore, it should be recognized that variations can exist in the presently described designs. According to some embodiments, a single-serving container can comprise five trapezoidal vacuum panels around the circumference of both the upper and the lower vacuum absorbing regions of the container.

As illustrated in FIGS. 1-9, the present teachings provide a one-piece plastic, e.g. polyethylene terephthalate (PET), container generally indicated at 10. The container 10 is substantially hourglass shaped when viewed from a side. Those of ordinary skill in the art would appreciate that the following teachings of the present disclosure are applicable to other containers, such as rectangular, triangular, hexagonal, octagonal or square shaped containers, which may have different dimensions and volume capacities. It is also contemplated that other modifications can be made depending on the specific application and environmental requirements.

As shown in FIGS. 1-9, the one-piece plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. An upper transition portion 32, in some embodiments, may be defined at a transition between the shoulder portion 22 and the sidewall portion 24. A lower transition portion 34, in some embodiments, may be defined at a transition between the base portion 28 and the sidewall portion 24.

The exemplary container 10 may also have a neck 23. The neck 23 may have an extremely short height, that is, becoming a short extension from the finish 20, or an elongated height, extending between the finish 20 and the shoulder portion 22. The upper portion 14 can define an opening 42 (FIG. 11). Although the container is shown as a drinking container, it should be appreciated that containers having different shapes, such as sidewalls and openings, can be made according to the principles of the present teachings.

As illustrated in FIGS. 1, 2, 4-7 and 9, the finish 20 of the plastic container 10 may include a threaded region 46 having threads 48, a lower sealing ridge 50, and a support ring 51. The threaded region 46 provides a means for attachment of a similarly threaded closure or cap (not illustrated). Alternatives may include other suitable devices that engage the finish 20 of the plastic container 10, such as a press-fit or snap-fit cap for example. Accordingly, the closure or cap (not illustrated) engages the finish 20 to preferably provide a hermetical seal of the plastic container 10. The closure or cap (not illustrated) is preferably of a plastic or metal material conventional to the closure industry and suitable for subsequent thermal processing.

Referring now to FIGS. 1, 2 and 4-8, sidewall portion 24 of the present teachings will now be described in greater detail. As discussed herein, sidewall portion 24 can comprise an hourglass shape that effectively absorbs the internal vacuum while maintaining its basic shape. The hourglass shape can be described as having two or more inverted conical or barrel sections that together form a reduced waist section. The reduced waist section can comprise a horizontal reinforcing belt with stiffening features at the minor diameter. This structure results in separate upper and lower vacuum absorbing regions for improved vacuum and container performance.

Figure 2:
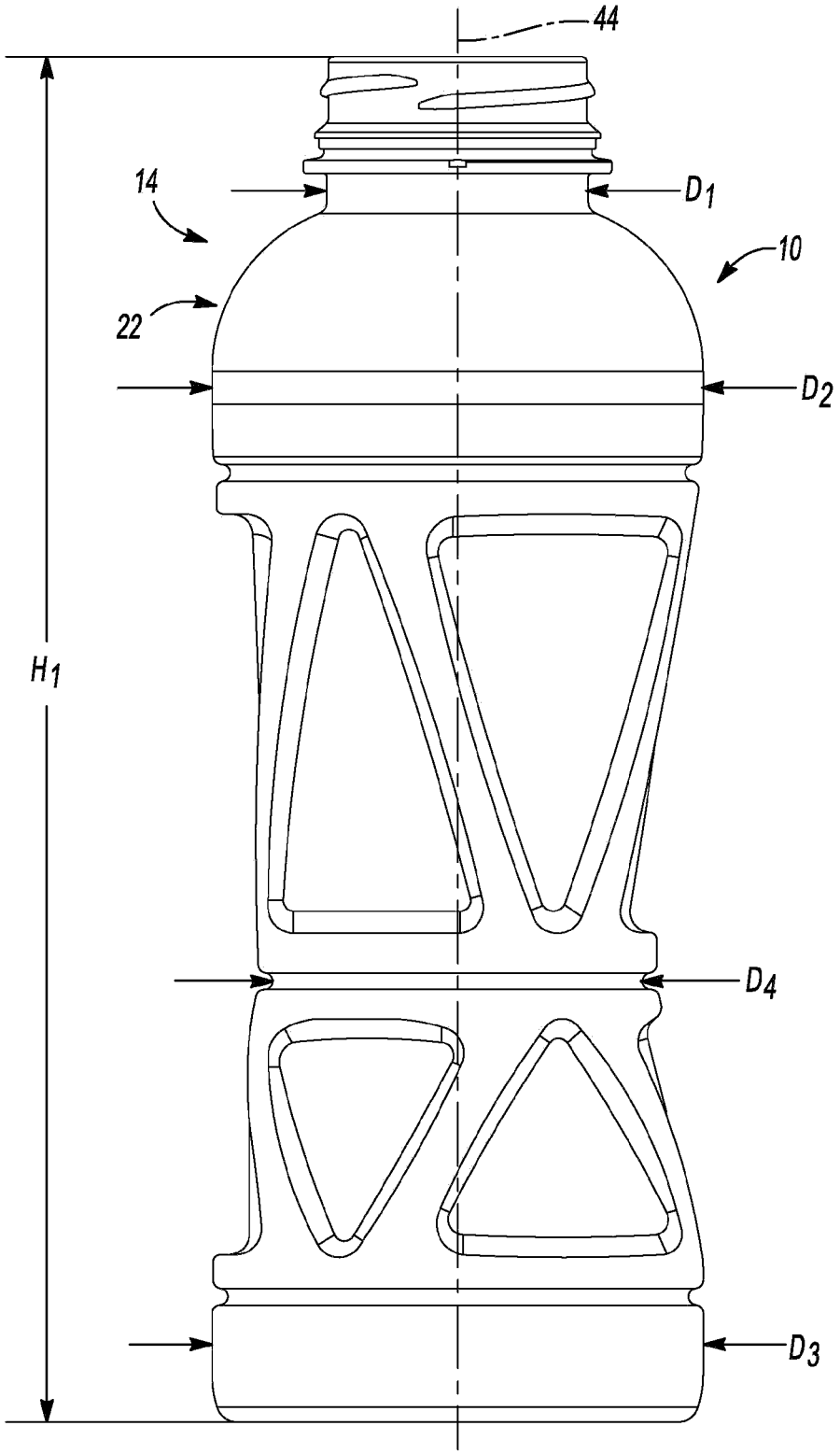
FIG. 2 is a side view of the container of FIG. 1.
Figure 3:
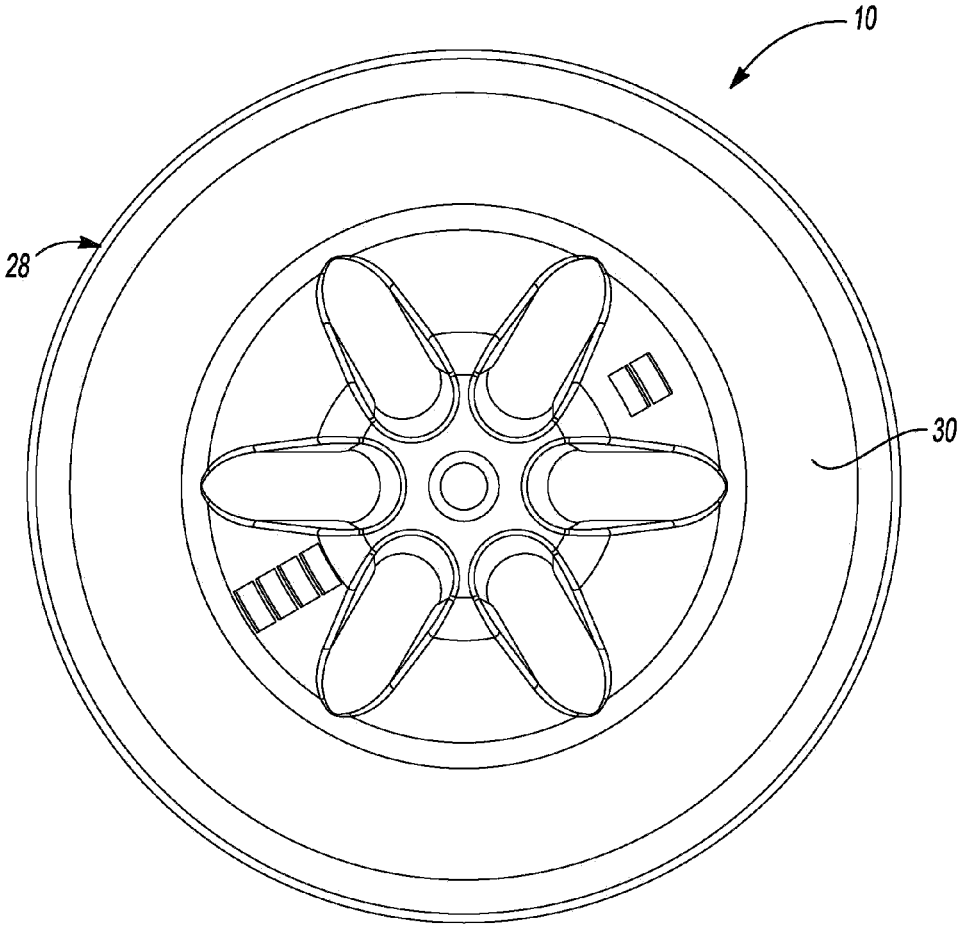
FIG. 3 is a bottom view of the container constructed in accordance with the embodiments of the present disclosure.

More particularly, in some embodiments, sidewall portion 24 of container 10 can comprise an upper vacuum absorbing region 60 and a lower vacuum absorbing region 62 joined together about a reduced waist section 64. As seen in FIGS. 1 and 2, upper vacuum absorbing region 60 and lower vacuum absorbing region 62 can comprise a generally conical shape having a minor diameter thereof joined along reduced waist section 64 to form the hourglass shape. It should be immediately recognized that upper vacuum absorbing region 60 and lower vacuum absorbing region 62 can have differing dimensions, particularly angle, length, and the like, as illustrated in FIGS. 1 and 2. Upper vacuum absorbing region 60 can be joined to shoulder portion 22 via upper transition portion 32. In some embodiments, upper transition portion 32 can include an inwardly directed rib 66 forming a reinforcement rib for container integrity and/or vacuum absorption. Similarly, in some embodiments, lower vacuum absorbing region 62 can be joined to base portion 28 via lower transition portion 34. In some embodiments, lower transition portion 34 can include an inwardly directed rib 68 forming a reinforcement rib for container integrity and/or vacuum absorption.

In some embodiments, each of the upper vacuum absorbing region 60 and lower vacuum absorbing region 62 can comprise a plurality of vacuum panels 70. In some embodiments, as seen in FIGS. 1 and 2, the plurality of vacuum panels 70 can each have a generally triangular shape and have a generally equidistant spacing and alternating orientation (i.e. triangular base portion of one panel being low and adjacent triangular base portions being high) around sidewall portion 24 of container 10. While such spacing is useful, other factors such as labeling requirements or the incorporation of grip features or graphics may require spacing other than equidistant. The container 10 illustrated in FIGS. 1 and 2 can comprise six (6) vacuum panels 70 in each of upper vacuum absorbing region 60 and lower vacuum absorbing region 62. Lands or inclined columns 72 are defined between adjacent vacuum panels 70, which provide structural support and rigidity to sidewall portion 24 of container 10.

Still referring to FIGS. 1 and 2, vacuum panels 70 can comprise an underlying surface 74 and perimeter wall, surface, or edge 76 (collectively referred to as a perimeter surface 76, hereinafter). Perimeter surface 76 can define a transition between underlying surface 74 and sidewall portion 24 (or lands 72, in some embodiments), and in some embodiments can define an upstanding wall. Still further, in some embodiments, perimeter surface 76 can have a varying wall height (that is, spacing between sidewall portion 24 (or lands 72) and underlying surface 74). In this way, underlying surface 74 can be shaped or otherwise inclined relative to sidewall portion 24. It should be noted that in some embodiments it is desirable that the transition between perimeter surface 76 and underlying surface 74 and/or sidewall portion 24 is abrupt in order to maximize the local strength as well as to form a geometrically rigid structure. The resulting localized strength increases the resistance to creasing in the sidewall portion 24.

Referring to FIGS. 1 and 2, upper vacuum absorbing region 60 and lower vacuum absorbing region 62 can be joined along reduced waist section 64 such that lands 72 of upper vacuum absorbing region 60 and lower vacuum absorbing region 62 meet along and transition via a circumferential, inwardly-directed rib 78 forming a reinforcement rib for container integrity and/or vacuum absorption. It should be seen that a diameter of the reduced waist section 64 (and more so, the diameter of inwardly-directed rib 78) is less than a major diameter of upper vacuum absorbing region 60 and/or lower vacuum absorbing region 62, thereby resulting in a restricted central area and the afore-mentioned hourglass shape.

In some embodiments, as illustrated in FIGS. 4-8, vacuum panels 70 can comprise underlying surface 74 and perimeter surface 76. Perimeter surface 76 can define a transition surface between adjacent underlying surfaces 74, which, in some embodiments, is a single radius surface tangential to adjacent underlying surfaces 74. It should be understood that other transitionary surfaces may be used that are generally extensions of underlying surface 74, which can form consistent, uniform interconnections. Still further, in some embodiments, perimeter surface 76 can have a varying wall shape and/or wall thickness. In such embodiments, an upstanding perimeter surface 76 can extend from underlying surface 74 to sidewall portion 24 (or lands 72). Depending upon the shape of underlying surface 74 and sidewall portion 24 (or lands 72), this transition can result in a general arcuate sweeping surface 74'.

Referring to FIGS. 4-8, upper vacuum absorbing region 60 and lower vacuum absorbing region 62 again can be joined along reduced waist section 64 such that lands 72 of upper vacuum absorbing region 60 and lower vacuum absorbing region 62 meet along and transition via a circumferential, inwardly-directed rib 78 forming a reinforcement rib for container integrity and/or vacuum absorption. It should be seen that a diameter of the reduced waist section 64 (and more so, the diameter of inwardly-directed rib 78) is less than a major diameter of upper vacuum absorbing region 60 and/or lower vacuum absorbing region 62, thereby resulting in a restricted central area and the afore-mentioned hourglass shape. Formation of inwardly-directed rib 78 can include a generally radiused shape 78' (see FIGS. 1, 2, 4, and 5); generally inclined, linear (when viewed in cross-section) surfaces 78" (see FIGS. 6 and 7); or any other shape desired for aesthetic, load bearing, vacuum bearing characteristics. Moreover, reduced waist section 64 can form a constant circumferential diameter.

Figure 8:
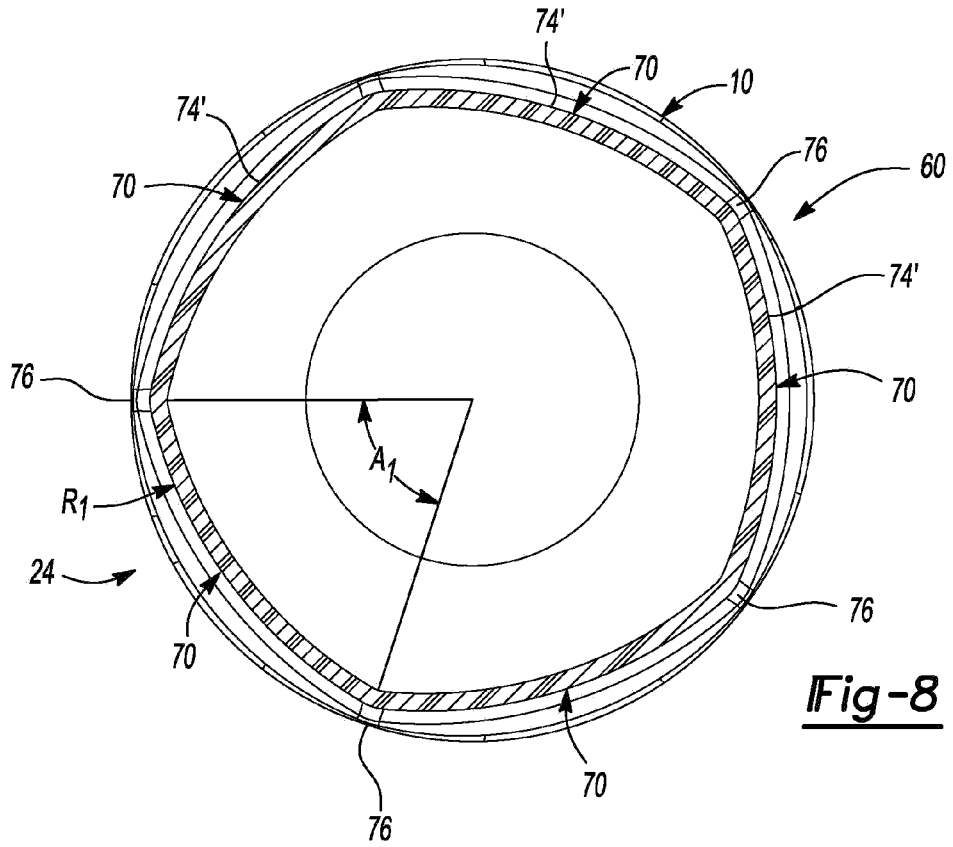
FIG. 8 is a cross-sectional view taken along line 8-8 of FIG. 6.
Figure 9:
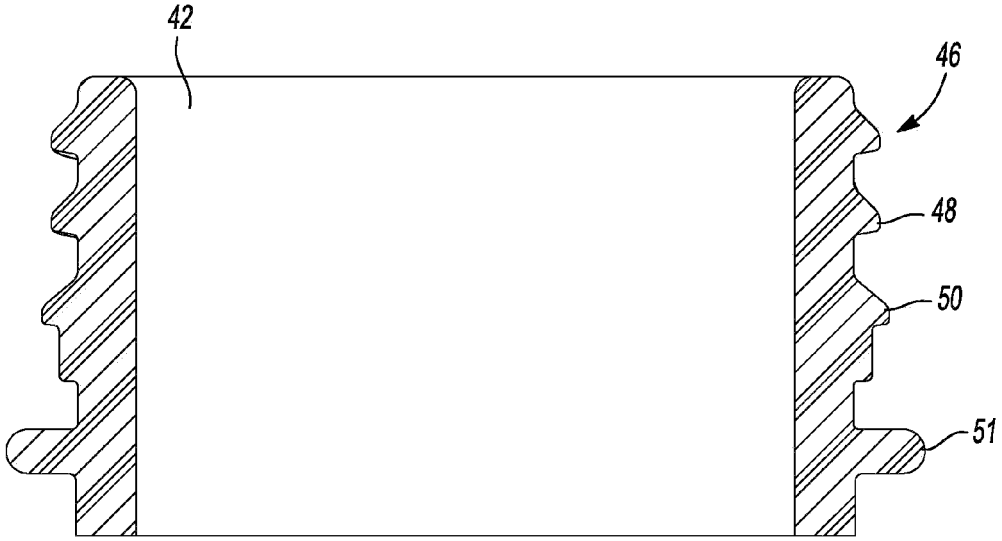
FIG. 9 is a cross-sectional view taken along line 9-9 of FIG. 6 of the finish of the container.

With particular reference to FIG. 8, it should be understood that the present teachings can comprise generally convex shaped vacuum panels 70. Each of the vacuum panels 70, as described herein, be directly coupled to each other via perimeter surface 76 (in this form, a surface) such that convex underlying surface 74 sweeps along and is joined by perimeter surface 76. This convex shape can be useful for absorbing vacuum forces during hot-filling. That is, upon filling, capping, sealing and cooling, underlying surfaces 74 can be pulled inwardly, toward the central longitudinal axis of container 10, displacing volume. In some embodiments, this response can be significant to cause underlying surface 74 to flex more inwardly to a reduced convex shape, flat shape, or concave shape, depending on the extent of desired deflection.

Figure 6:
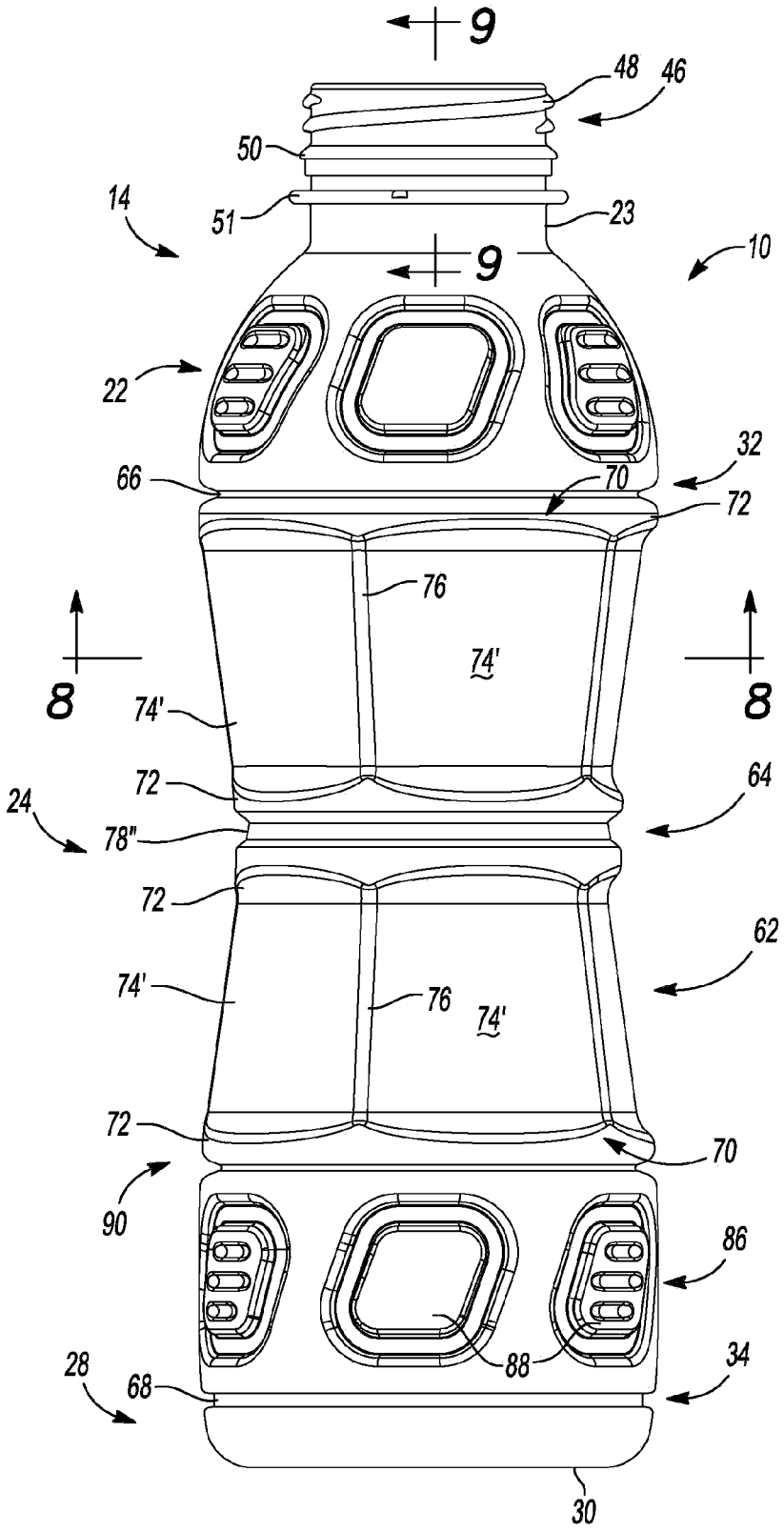
FIG. 6 is a front view of a plastic container constructed in accordance with other embodiments of the present disclosure.
Figure 7:
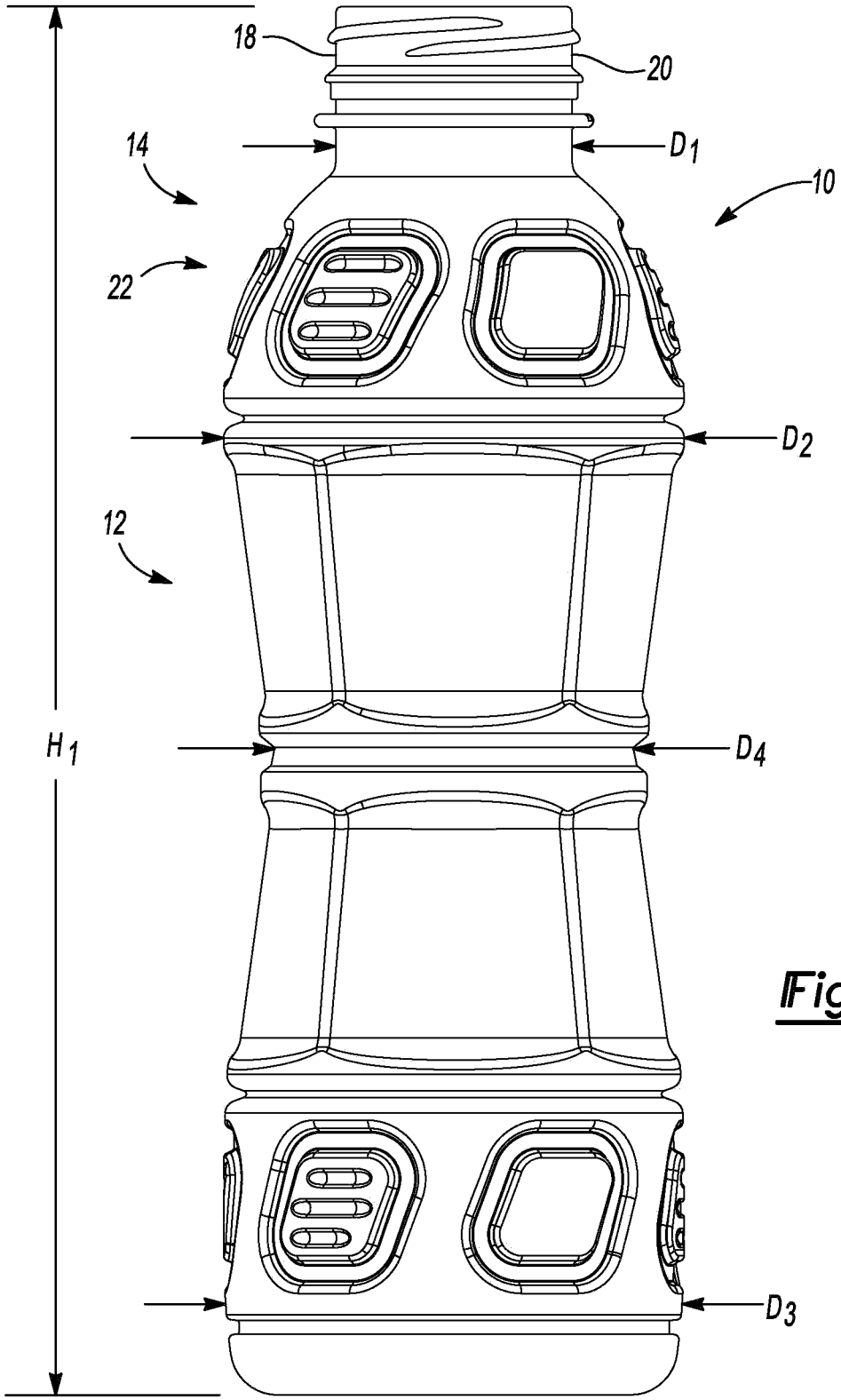
FIG. 7 is a side view of the container of FIG. 6.

As seen in FIGS. 6 and 7, in some embodiments, sidewall portion 24 can comprise an intermediate section 86 disposed between lower vacuum absorbing region 62 and base portion 28, between upper vacuum absorbing region 60 and shoulder portion 22 (not shown) or both. In some embodiments, intermediate section 86 can form a part of shoulder portion 22, sidewall portion 24, and/or base portion 28. In some embodiments, intermediate portion 86, shoulder portion 22, base portion 28, or combinations thereof can comprise additional vacuum features 88 formed therein. Furthermore, container 10 can comprise intermediate transition portion(s) 90 between intermediate section 86 and adjoining region or portion.

The plastic container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure (not illustrated) before cooling. In addition, the plastic container 10 may be suitable for other high-temperature pasteurization or retort filling processes or other thermal processes as well. In another example, the commodity may be introduced into the container under ambient temperatures.

The plastic container 10 of the present disclosure is a blow molded, biaxially oriented container with a unitary construction from a single or multi-layer material. A well-known stretch-molding, heat-setting process for making the one-piece plastic container 10 generally involves the manufacture of a preform (not shown) of a polyester material, such as polyethylene terephthalate (PET), having a shape well known to those skilled in the art similar to a test-tube with a generally cylindrical cross section. An exemplary method of manufacturing the plastic container 10 will be described in greater detail later.

An exemplary method of forming the container 10 will now be described. A preform version of container 10 includes a support ring 51, which may be used to carry or orient the preform through and at various stages of manufacture. For example, the preform may be carried by the support ring 51, the support ring 51 may be used to aid in positioning the preform in a mold cavity, or the support ring 51 may be used to carry an intermediate container once molded. At the outset, the preform may be placed into the mold cavity such that the support ring 51 is captured at an upper end of the mold cavity. In general, the mold cavity has an interior surface corresponding to a desired outer profile of the blown container. More specifically, the mold cavity according to the present teachings defines a body forming region, an optional moil forming region and an optional opening forming region. Once the resultant structure, hereinafter referred to as an intermediate container, has been formed, any moil created by the moil forming region may be severed and discarded. It should be appreciated that the use of a moil forming region and/or opening forming region are not necessarily in all forming methods.

In one example, a machine (not illustrated) places the preform heated to a temperature between approximately 190° F. to 250° F. (approximately 88° C. to 121° C.) into the mold cavity. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the intermediate container thereby molecularly orienting the polyester material in an axial direction generally corresponding with a central longitudinal axis 44 of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the intermediate container. The pressurized air holds the mostly biaxial molecularly oriented polyester material against the mold cavity for a period of approximately two (2) to five (5) seconds before removal of the intermediate container from the mold cavity. This process is known as heat setting and results in a heat-resistant container suitable for filling with a product at high temperatures.

Alternatively, other manufacturing methods, such as for example, extrusion blow molding, one step injection stretch blow molding and injection blow molding, using other conventional materials including, for example, high density polyethylene, polypropylene, polyethylene naphthalate (PEN), a PET/PEN blend or copolymer, and various multi-layer structures may be suitable for the manufacture of plastic container 10. Those having ordinary skill in the art will readily know and understand plastic container manufacturing method alternatives.

Turning now to the figures, exemplary dimensions for the container 10 will be described. It is appreciated that other dimensions may be used. With reference to the embodiment of FIGS. 1 and 2, a diameter D1 of the neck 23 below the support ring 51 may be 39.62 mm (1.56 inches). A diameter D2 of the upper transition portion 32 (and in some embodiments the major diameter of container 10) may be 74.53 mm (2.93 inches). A diameter D3 of the base portion 28 (and in some embodiments the major diameter of container 10) may be 74.53 mm (2.93 inches). A height H1 taken from the top to the contact surface of the container 10 (overall height) may be 206.21 mm (8.12 inches).

Figure 4:
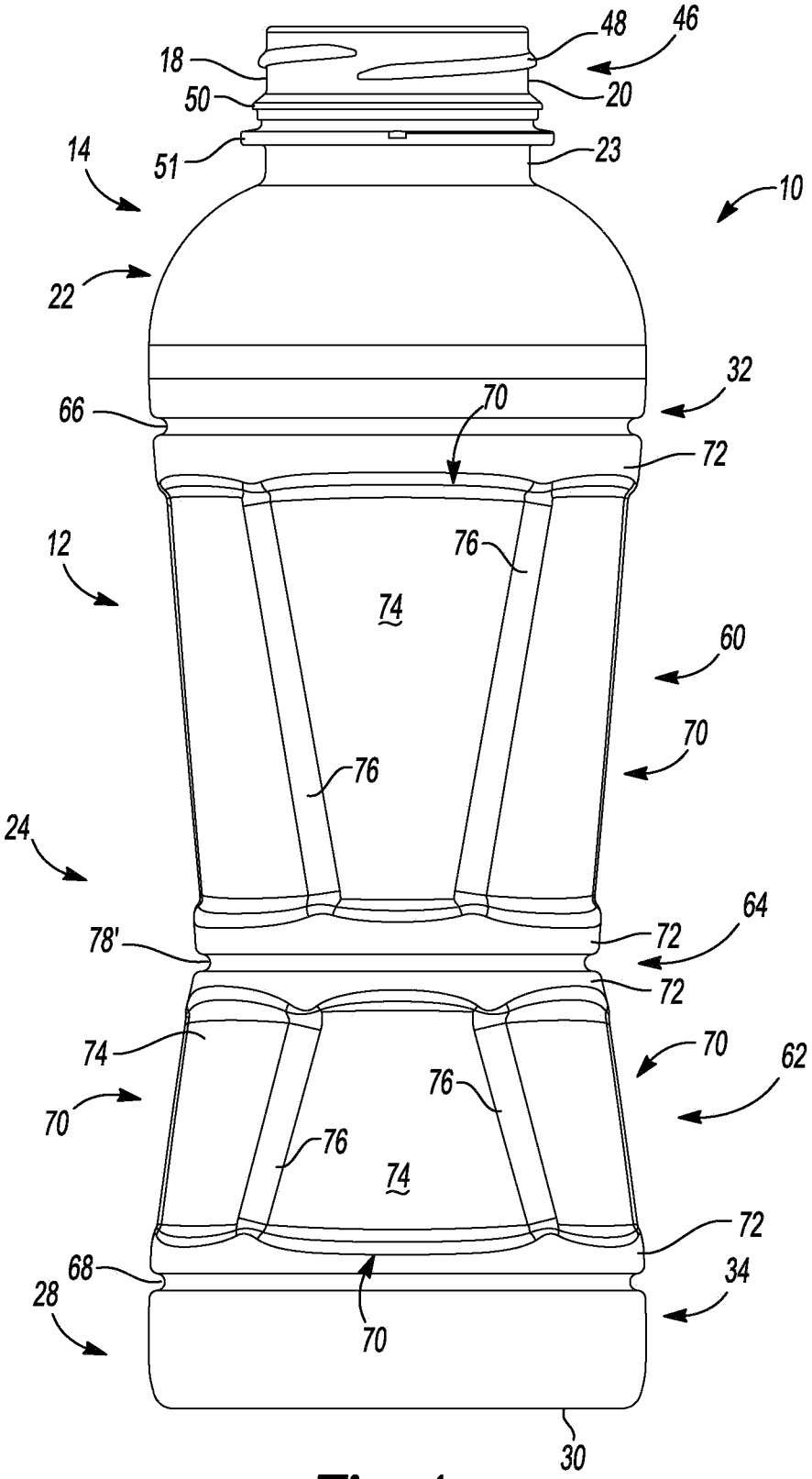
FIG. 4 is a front view of a plastic container constructed in accordance with other embodiments of the present disclosure.
Figure 5:
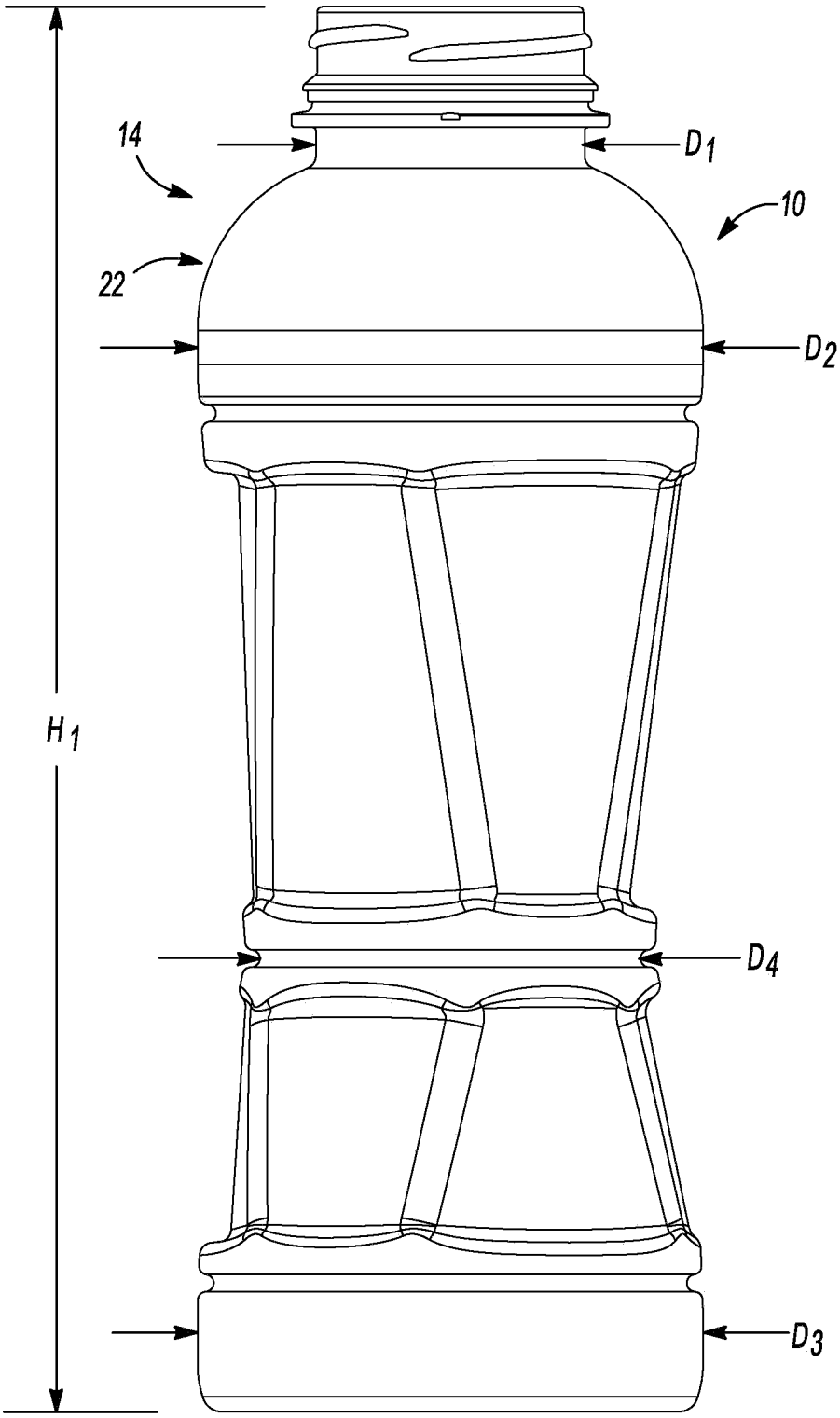
FIG. 5 is a side view of the container of FIG. 4.

With reference to the embodiment of FIGS. 4 and 5, a diameter D1 of the neck 23 below the support ring 51 may be 39.62 mm (1.56 inches). A diameter D2 of the upper transition portion 32 (and in some embodiments the major diameter of container 10) may be 74.53 mm (2.93 inches). A diameter D3 of the base portion 28 (and in some embodiments the major diameter of container 10) may be 74.53 mm (2.93 inches). A height H1 taken from the top to the contact surface of the container 10 (overall height) may be 207.41 mm (8.17 inches).

With reference to the embodiment of FIGS. 6-8, a diameter D1 of the neck 23 below the support ring 51 may be 34.94 mm (1.38 inches). A diameter D2 of the upper transition portion 32 (and in some embodiments the major diameter of container 10) may be 74.53 mm (2.93 inches). A diameter D3 of the base portion 28 (and in some embodiments the major diameter of container 10) may be 74.53 mm (2.93 inches). A diameter D4 of the sidewall portion 24 at its minimum point may be 53 mm (2.09 inches). Accordingly, the diameter D4 may be at least 10 mm (0.40 inch) less than at least one of the diameter D2 and diameter D3. In some embodiments, the diameter D4 may be at least 15 mm (0.60 inch) less than at least one of the diameter D2 and diameter D3 A height H1 taken from the top to the contact surface of the container 10 (overall height) may be 206.21 mm (8.12 inches). As seen in FIG. 8, an angle A1 between the centers of adjacent perimeter surface 76 can be 72° and each underlying surface 74' (or 74 in FIGS. 1 and 4) can form an arcuate surface having a radius R1 of 44.78 mm (1.76 inches).

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heat set container having a longitudinal axis comprising:

a shoulder portion;

a sidewall portion extending from said shoulder portion to a base, said base closing off an end of said container; said shoulder portion, said sidewall portion and said base cooperating to define a receptacle chamber within said container into which product can be filled, said sidewall portion having an upper vacuum absorbing region joined to a lower vacuum absorbing region at a reduced waist section, said upper vacuum absorbing region extending downwardly from said shoulder portion and forming a first major container diameter, said lower vacuum absorbing region extending upwardly from said base and forming a second major container diameter, said reduced waist section forming a minor container diameter, said minor container diameter being less than at least one of said first major container diameter and said second major container diameter; and a plurality of vacuum panels disposed about at least one of said upper vacuum absorbing region and said lower vacuum absorbing region, the plurality of vacuum panels defined by a respective underlying surface that is bound by a respective peripheral surface, the peripheral surface including an upper end and a lower end, an entirety of the underlying surface being tapered between the upper end and the lower end, the underlying surfaces of the vacuum panels being generally triangular in shape, the plurality of vacuum panels being alternatingly oriented about the longitudinal axis such that adjacent pairs of the underlying surfaces about the longitudinal axis are inverted relative to each other.

2. The heat set container according to claim 1, said perimeter surfaces each being an upstanding wall that protrudes outward from the respective underlying surface resulting in the underlying surface of each of said plurality of vacuum panels being inset relative to lands surrounding said respective vacuum panel.

3. The heat set container according to claim 1 wherein adjacent underlying surfaces are coupled via respective ones of the perimeter surfaces, said perimeter surfaces each being tangential to adjacent ones of the underlying surfaces.

4. The heat set container according to claim 1 wherein each of said underlying surfaces are convex absent a vacuum load within said receptacle chamber.

5. The heat set container according to claim 1 wherein said reduced waist section comprises an inwardly directed rib.

6. The heat set container according to claim 5 wherein said inwardly directed rib is a radiused rib.

7. The heat set container according to claim 5 wherein said inwardly directed rib comprises at least one linearly-inclined circumferential surface.

8. The heat set container according to claim 1 wherein said upper vacuum absorbing region and said lower vacuum absorbing region are shaped as opposing and converging conical regions.

9. The heat set container according to claim 1 wherein said upper vacuum absorbing region and said lower vacuum absorbing region are collectively shaped to provide flexible absorption of an internal vacuum within said receptacle chamber.

10. The heat set container according to claim 1 further comprising:

a transition portion between said shoulder portion and said upper vacuum absorbing region, said transition portion having an inwardly directed rib.

11. The heat set container according to claim 1 further comprising:

a transition portion between said base and said lower vacuum absorbing region, said transition portion having an inwardly directed rib.

12. The heat set container according to claim 1 wherein said reduced waist section defines a consistent circumferential diameter.

13. The heat set container according to claim 2, wherein the lands extend helically about the longitudinal axis.

* * * * *